US006897619B2

(12) United States Patent
Shimizu

(10) Patent No.: US 6,897,619 B2
(45) Date of Patent: May 24, 2005

(54) CONTROL CIRCUIT FOR SUPPLYING A CURRENT TO DISPLAY DEVICES

(75) Inventor: Nobuyuki Shimizu, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 3 days.

(21) Appl. No.: 10/456,752

(22) Filed: Jun. 9, 2003

(65) Prior Publication Data

US 2003/0227261 A1 Dec. 11, 2003

(30) Foreign Application Priority Data

Jun. 11, 2002 (JP) ..... 2002-169636

(51) Int. Cl.[7] ..... G09G 3/10

(52) U.S. Cl. ..... 315/169.3; 315/169.1; 345/76; 345/77

(58) Field of Search ..... 315/169.3, 169.1, 315/291; 345/76–78, 204, 214, 211

(56) References Cited

U.S. PATENT DOCUMENTS 6,078,150 A * 6/2000 Koyanagi et al. ..... 315/169.3
6,204,610 B1 * 3/2001 Komiya ..... 315/169.1
6,518,941 B1 * 2/2003 Kimura ..... 315/169.3
6,545,651 B2 * 4/2003 Nishigaki et al. ..... 345/76

FOREIGN PATENT DOCUMENTS

JP 01192573 A 8/1989
JP 2001-138567 5/2001

* cited by examiner

*Primary Examiner*—Don Wong
*Assistant Examiner*—Ephrem Alemu
(74) *Attorney, Agent, or Firm*—Volentine Francos & Whitt P.L.L.C.

(57) ABSTRACT

A control circuit includes a plurality of drive current output circuits, a control voltage generating circuit, a first current output circuit, a second current output circuit, a voltage divider and a compensation voltage generating circuit. The voltage divider has one end connected to the control voltage generating circuit and a plurality of nodes each of which connected to the respective drive current output. The drive current output circuit outputs the control voltage to the drive circuits based on a power supply voltage and the control voltage. The compensation voltage generating circuit outputs a compensated voltage based on the difference between the current outputted from the first current output circuit and the current outputted from the second current output circuit. In order to supply the compensation voltage to the other end of the voltage divider, the values of the respective control voltage are equalized.

10 Claims, 9 Drawing Sheets

(a)

(b)

Prior Art

CONTROL CIRCUIT FOR SUPPLYING A CURRENT TO DISPLAY DEVICES

CROSS REFERENCE TO RELATED APPLICATION

The present application claims priority under 35 U.S.C. §119 to Japanese Patent Application No. 2002-169636, filed Jun. 11, 2002, which is herein incorporated by reference in their entirety for all purposes.

BACKGROUND OF THE INVENTION

1. Field of the Invention

The present invention relates to a control circuit for driving a current-driven display unit using organic electroluminescent devices (hereinafter called "EL devices"), light-emitting diodes (hereinafter called "LEDs"), etc. which respectively emit light according to the supply of currents.

2. Description of the Related Art

FIG. 1 is a circuit diagram showing a conventional control circuit.

The conventional driver principally comprises a driver circuit unit 10, a control voltage generating circuit 20 and EL devices D1 through D6. The driver circuit unit 10 comprises a plurality of drive current output circuits Dr1 through Dr6. The drive current output circuits Dr1 through Dr6 output a drive current to the corresponding EL devices D1 through D6. Specially, the drive current output circuit Dr1 outputs the drive current to the EL device D1. The control voltage generating circuit outputs a control voltage Vc1 to the drive current output circuit Dr1 through Dr6 for controlling the current outputted from the drive current output circuits Dr1 through Dr6.

The control voltage generating circuit 20 is connected between a power node Vdd that is applied a power supply voltage and a ground node Vss that is applied a ground potential. Each of an anode of the EL devices D1 through D6 are connected to each of the drive current output circuits Dr1 through Dr6, and all of a cathode of the EL devices D1 through D6 are connected to the ground node.

Each of the drive current output circuit Dr1 through Dr6 has a same structure and each of which includes two p-channel metal-semiconductor-oxide (hereinafter called "PMOS) transistors. For example, the drive current output circuit Dr1 includes a PMOS transistor Q1 and a PMOS transistor Q2. The PMOS transistor Q1 has a source connected to the power node Vdd, a gate connected to the control voltage generating circuit 20 and a drain. The PMOS transistor Q2 has a source connected to the drain of the PMOS transistor Q1, a drain connected to the anode of the EL device D1, and a gate that is applied a switching signal S1. Also, the PMOS transistors Q3, Q5, Q7, Q9 and Q11 of other drive current output circuit Dr2 through Dr6 are connected between the power supply voltage Vdd and the control voltage generating circuit 20, respectively.

When the switching signal S1 is applied to the gate of the PMOS transistor Q2 of the driver circuit Dr1, the PMOS transistor Q2 is turned on. Then the PMOS transistor Q2 outputs a current Id1 to the EL device D1 for driving the EL device D1. Also, each gate of PMOS transistors Q4, Q6, Q8, Q10 and Q12 is applied switching signals S2, S3, S4, S5 and S6, respectively. The drive current output circuits Dr2 through Dr6 respectively output the drive currents Id2 through Id6 to the EL devices D2 through D6, in response to input the switching signals S2 through S6. The drive currents Id2 through Id6 drive the EL devices D2 through D6.

The control voltage generating circuit 20 includes a PMOS transistor Q21, a PMOS transistor Q22, a resistor R1 and an operational amplifier OP1. The operational amplifier OP1 has an inversion terminal that is applied the reference voltage Vref, a non-inversion terminal and an output terminal. The PMOS transistor Q21 has a source connected to the power supply voltage Vdd, a drain and a gate connected to the output terminal of the operational amplifier OP1. The PMOS Q22 has a source connected to the drain of the PMOS transistor Q21, a drain connected to the ground potential Vss via the resistor R1 and a gate connected to the non-inversion terminal of the operational amplifier OP1.

The gate of the PMOS transistor Q1 of the drive circuit Dr1 is connected to the output terminal of the operational amplifier OP1. Since the gate of the PMOS transistor Q1 is connected to the gate of the PMOS transistor Q21, these two transistors Q1 and Q21 constitute a current mirror circuit. Thus, a current flows through the PMOS transistor Q1 is determined based on a ratio between a dimension (corresponding to a ratio W/L between the width of the gate of the PMOS transistor Q21 and the length of its gate) of the PMOS transistor Q21 and a dimension (corresponding to a ratio W/L between the width of the gate of the PMOS transistor Q1 and the length of its gate) of the PMOS transistor Q1. Also, each of the PMOS transistors Q2 through Q6 is constitute a current mirror circuit with the PMOS transistor Q21.

The operational amplifier OP1 outputs a control voltage Vc1. The control voltage Vc1 is applied to the gate of the PMOS transistor Q21 and the driver circuits Dr1 through Dr6. The operational amplifier OP1 controls the control voltage Vc1, such that the reference voltage Vref and the voltage applied on the drain of the PMOS transistor Q22 become equal. Therefore, the operational amplifier OP1 outputs the reference voltage constantly. Since the operational amplifier OP1 keeps the output voltage constantly, the PMOS transistor Q21 keeps the current Iref constantly. The PMOS transistor Q21 and the PMOS transistors Q1, Q3, Q5, Q7, Q9 and Q11 constitute a current mirror circuit. That is, when the dimensions of these transistors Q1, Q3, Q5, Q7, Q9, Q11 and Q21 are equal, the currents Id1 through Id6 and the Iref are equal.

FIG. 2 shows a layout of the control voltage generating circuit 20 and the driver circuit unit 10 on the semiconductor substrate 100.

On the semiconductor substrate 100, the control voltage generating circuit 20 is located near the drive circuit unit 10. The power supply voltage Vdd is supplied to the control voltage generating circuit 20 and the drive circuit unit 10. The control voltage generating circuit 20 supplies the control voltage Vc1 to the drive circuit unit 10. The EL devices D1 through D6 are provided outside of the semiconductor substrate 100. The drive current output circuits Dr1 through Dr6 are located along the direction A in series.

In design of the driver, the currents Id1 through Id6 are approximately equal each other. However, when few hundred of the drive current output circuits are formed on the semiconductor substrate 100 in series, the length of the driver circuit unit 10 in the direction A as shown in FIG. 2 is expanded. Each of the transistors Q1 through Q12 in the respective drive current output circuits Dr1 through Dr6 are designed so as to have a same characteristic. However, each of the transistors that are manufactured on the semiconductor substrate has a various characteristics. As a result, it may be different from the characteristic of the transistor in the drive current output circuit located near the control voltage generating circuit to a characteristic of the transistor in the drive current output circuit located far from the control voltage generating circuit. That is, the current outputted from the drive current output circuit that is located far from the control voltage generating circuit 20 may be different from the reference current Iref.

FIG. 3(*a*) shows the control voltage Vc that is applied to the each drive current output circuit Dr1 through Dr6. FIG. 3(*b*) shows various current values Id1 through Id6 which change based on respective distances from the control voltage generating circuit 20 to the drive current output circuits Dr1 through Dr6.

FIG. 3(*b*) shows that the current Id1 outputted from the drive current output circuit Dr1 that located nearest to the control voltage generating circuit 20 is larger than the current Id6 outputted from the drive current output circuit Dr6 that located farthest from the control voltage generating circuit 20. That is, the current value outputted from the drive current output circuit decreases as the distance increases.

Accordingly, an object of the present invention is providing a control circuit to reduce the variation of the current values from each drive current output circuit.

SUMMARY OF THE INVENTION

According to one aspect of the present invention, there is provided a control circuit that includes a plurality of drive current output circuits, a control voltage generating circuit, a first current output circuit, a second current output circuit, a voltage divider and a compensation voltage generating circuit. The voltage divider has one end connected to the control voltage generating circuit and a plurality of nodes each of which connected to the respective drive current output. The drive current output circuit outputs the control voltage to the drive circuits based on a power supply voltage and the control voltage. The compensation voltage generating circuit outputs a compensated voltage based on the difference between the current outputted from the first current output circuit and the current outputted from the second current output circuit. In order to supply the compensation voltage to the other end of the voltage divider, the values of the respective control voltage are equalized.

BRIEF DESCRIPTION OF THE DRAWINGS

FIG. 3(*b*) is a diagram showing a current outputted from the drive current output circuit of the general control circuits.

FIG. 6(*b*) is a diagram showing a current outputted from the drive current output circuit of the first embodiment of the present invention.

DETAILED DESCRIPTION OF THE PREFERRED EMBODIMENTS

Figure 1:
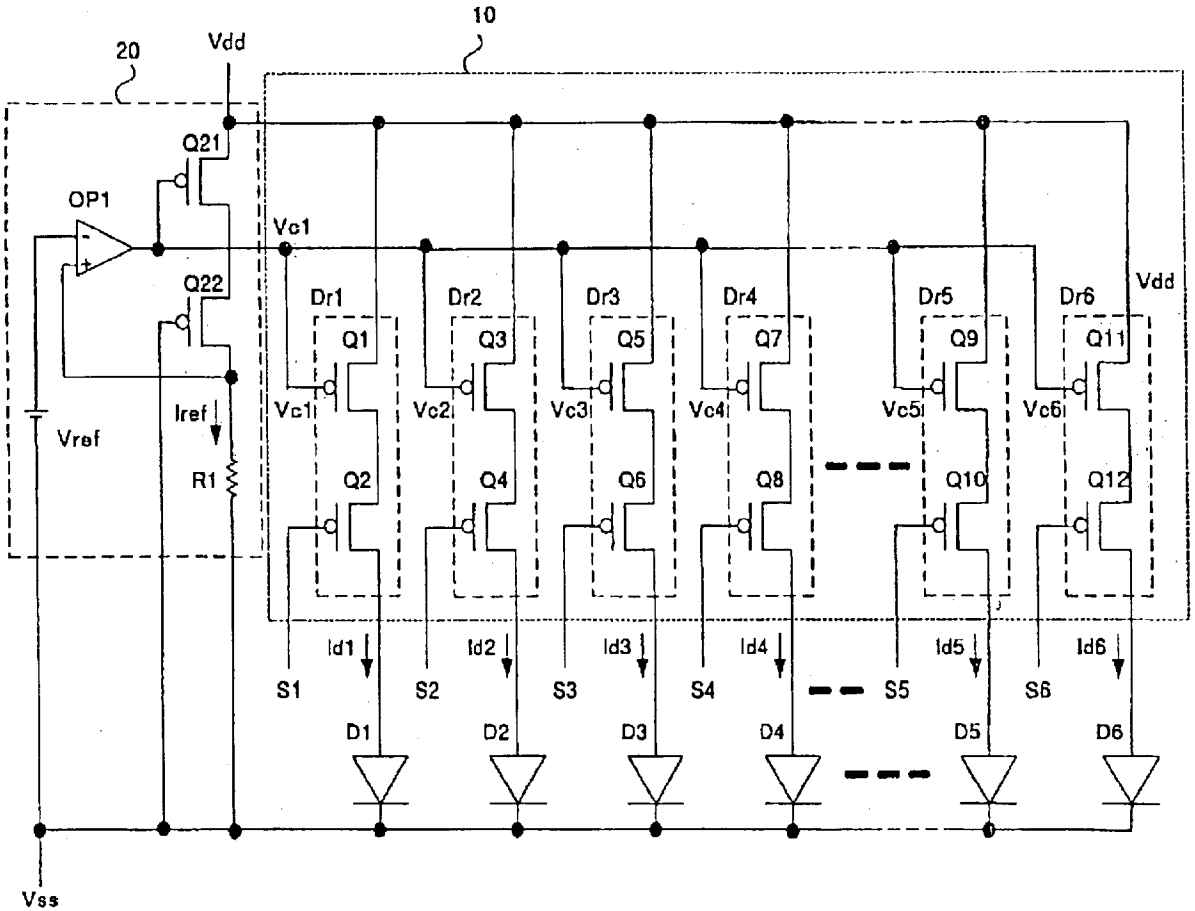
Fig. 1 Prior Art
FIG. 1 is a circuit diagram showing a general control circuit.
Figure 2:
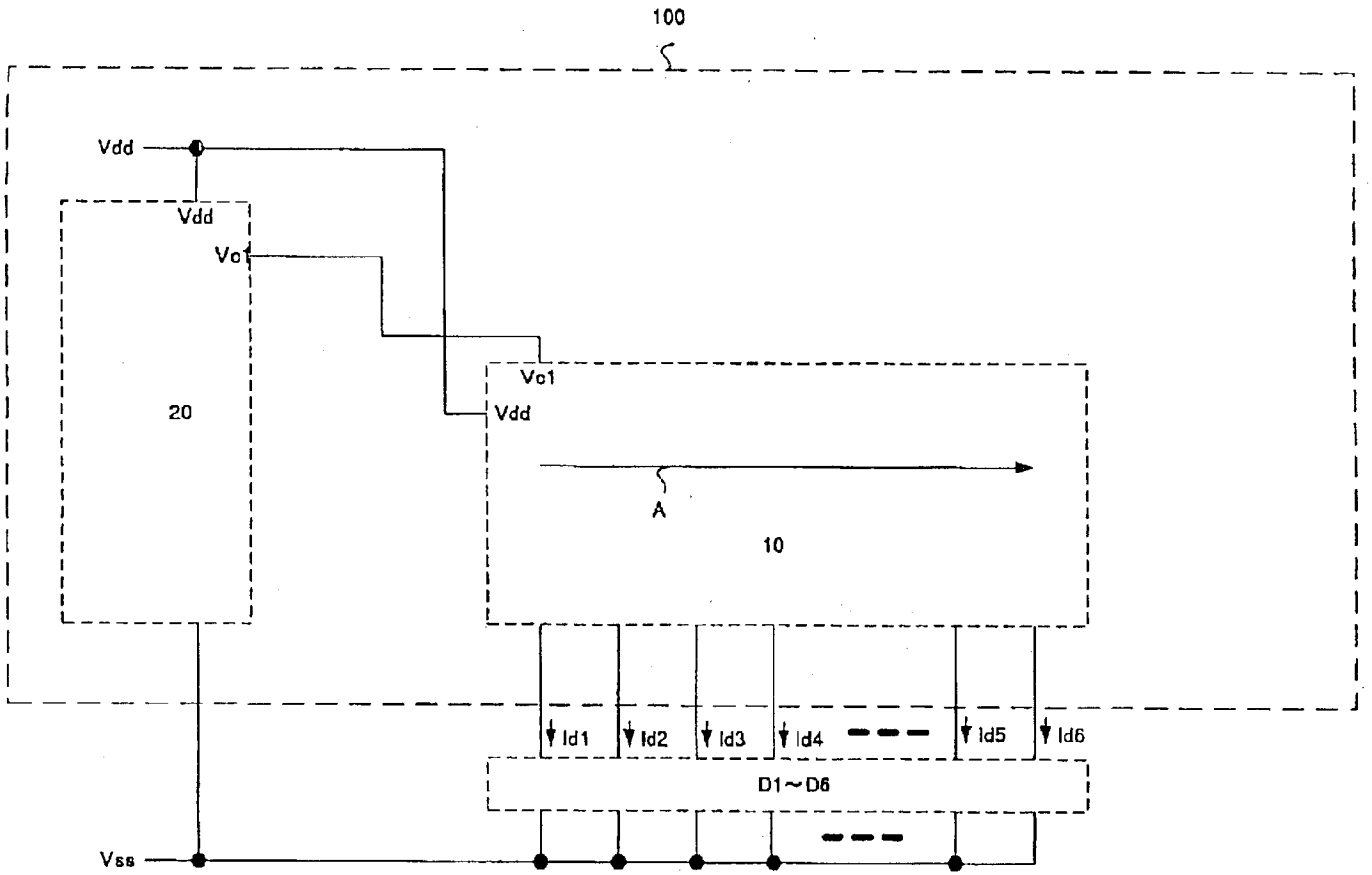
Prior Art Fig. 2
FIG. 2 is a layout diagram of respective circuit block of the general control circuit on a semiconductor substrate.
Figure 3:
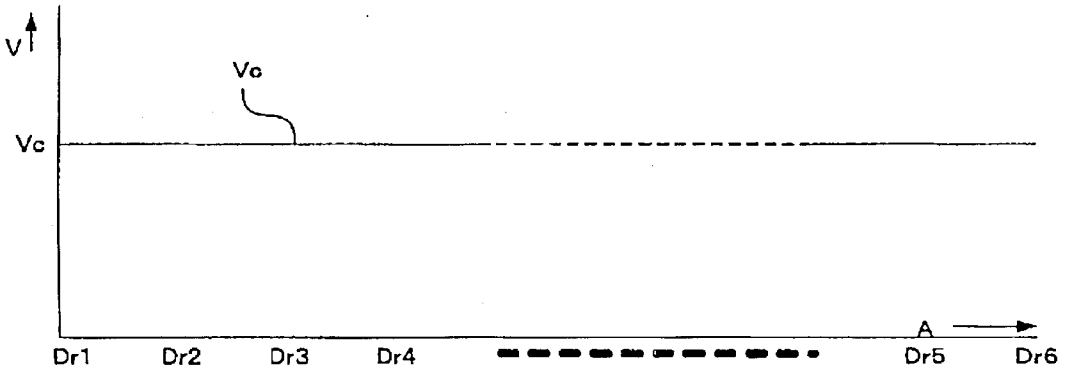
FIG. 3(*a*) is a diagram showing a voltage supplied to the drive current output circuit of the general control circuits.
Figure 3:
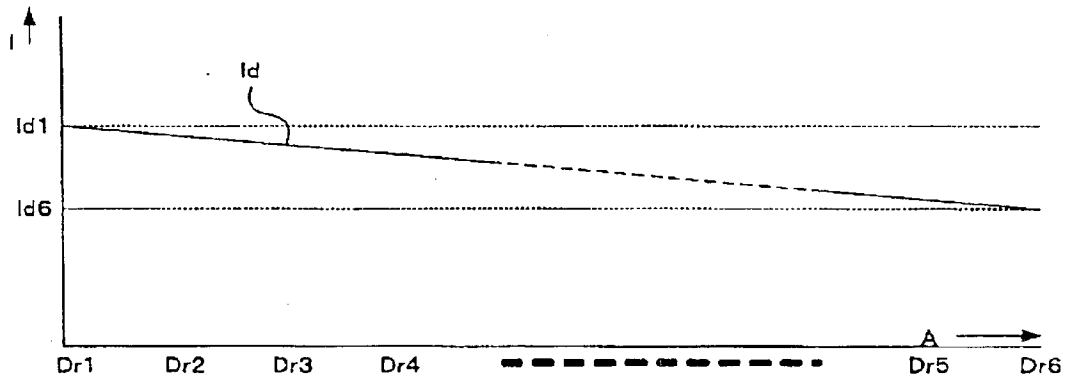

A semiconductor device according to preferred embodiments of the present invention will be explained hereinafter with reference to figures. In order to simplify explanation, like elements are given like or corresponding reference numerals through this specification and figures. Dual explanations of the same elements are avoided.

First Preferred Embodiment

Figure 4:
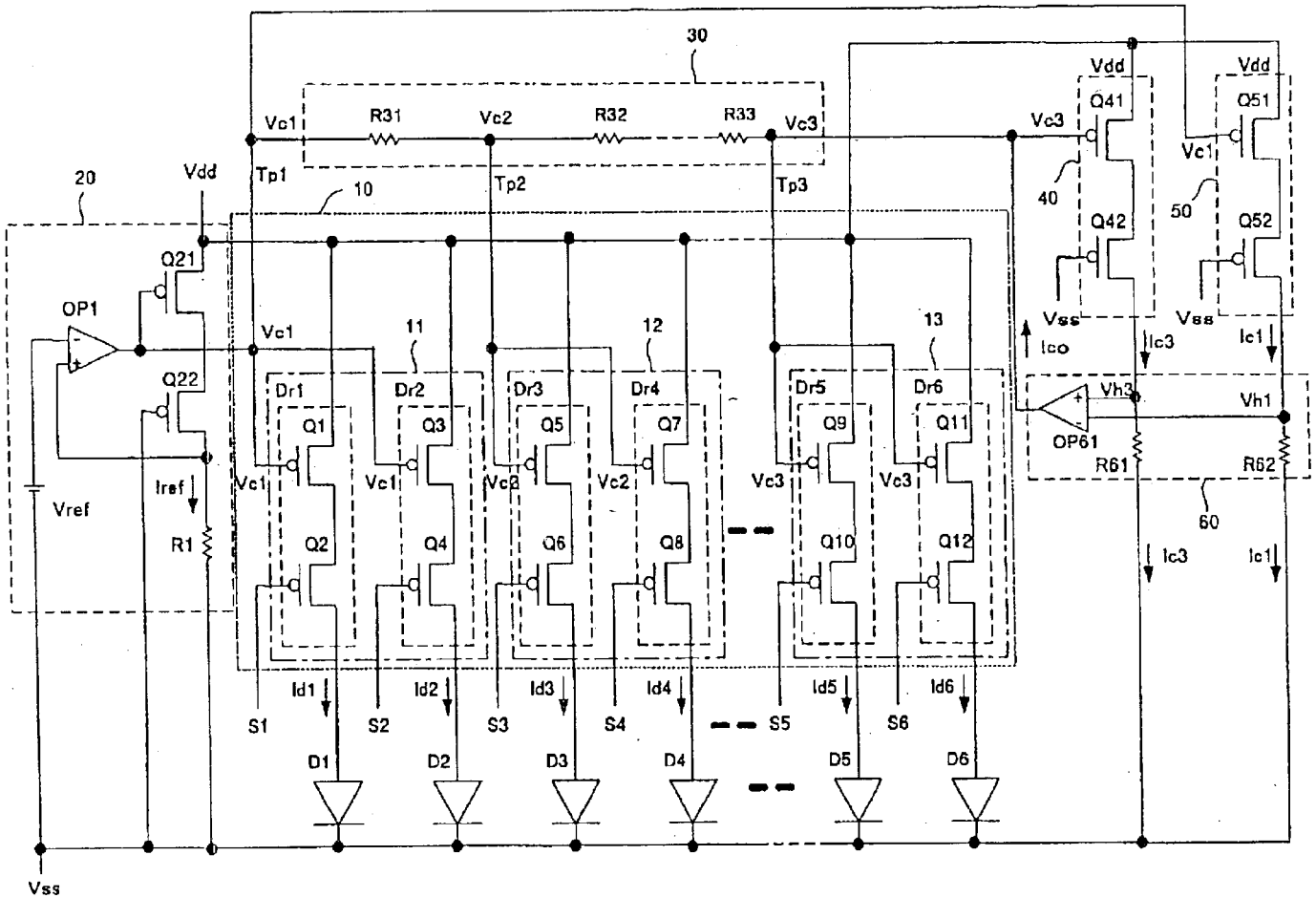
FIG. 4 is a circuit diagram of a control circuit according to a first embodiment of the present invention.

FIG. 4 is a circuit diagram showing a control circuit according to a first preferred embodiment of the present invention.

Major differences between the conventional control circuit as shown in FIG. 1 and the control circuit of the first embodiment of the present invention as shown in FIG. 4 are described as follows.

(1) The current output circuits in the drive circuit unit 10 has a plurality of driver current output circuit groups 11 through 13. The drive current output circuit group 11 includes a drive current output circuits Dr1 and Dr2. The drive current output circuit group 12 includes a drive current output circuits Dr3 and Dr4. The drive current output circuit group 13 includes a drive current output circuits Dr5 and Dr6. That is, the driver current output circuits Dr1 through Dr6 are divided into three small groups.

(2) A voltage divider 30 is added. The voltage divider 30 has a first end and a second end. The first end of the voltage divider 30 is connected to the control voltage generating circuit 20. The voltage divider 30 has resistors R31 through R33 each of that connected in series between the first end and the second end. The voltage divider 30 has output terminals Tp1 through Tp3 each of that output a voltage that divided by the resistors R31 through R33. The output terminal Tp1 is located nearest to the control voltage generating circuit 20 and the output terminal Tp3 is located farthest from the control voltage generating circuit 20.

(3) A first current output circuit 50 is added. The first current output circuit 50 detects the control voltage Vc1 that is outputted from the control voltage generating circuit 20, and outputs a current Ic1 corresponding to a value of the control voltage Vc1.

(4) A second current output circuit 40 is added. The second current output circuit 40 detects a control voltage Vc3 that is applied on a second terminal of the voltage divider 30, and outputs a current Ic2 corresponding to a value of the control voltage Vc3.

(5) A first resistor R62 is added between the first current output circuit 50 and the ground potential. In order to flow the current Ic1 in the first resistor R62, the first resistor R62 generates a first voltage Vh1.

(6) A second resistor R61 is added between the second current output circuit 40 and the ground potential. In order to flow the durrent Ic3 in the second resistor R61, the second resistor R61 generates a second voltage Vh3.

(7) An operational amplifier OP61 is added. The operational amplifier OP61 inputs the first voltage Vh1 and the second voltage Vh3, and outputs a compensated voltage Vcn. The compensated voltage Vcn has a voltage that is based on a difference between the first voltage Vh1 and the second voltage Vh3 to the output terminal Tp3.

The first resistor R62, the second resistor R61 and the operational amplifier OP61 define a compensation voltage generating circuit 60. The first resistor R62 and the second resistor R61 have the same resistance value in this embodiment.

The first current output circuit 50 has a PMOS transistor Q51 and a PMOS transistor Q52. The PMOS transistor Q51 has a source connected to the power supply voltage Vdd, a gate connected to the output terminal of the operational amplifier OP61 and a drain. The PMOS transistor Q52 has a source connected to the drain of the PMOS transistor Q51, a gate connected to the ground potential Vss and a drain which outputs the current Ic1.

The second current output circuit 40 has a PMOS transistor Q41 and a PMOS transistor Q42. The PMOS transistor Q41 has a source connected to the power supply voltage Vss, a gate connected to the second end of the voltage divider and a drain. The PMOS transistor Q42 has a source connected to the drain of the PMOS transistor Q41, a gate connected to the ground potential Vss and a drain which outputs the current Ic3.

The PMOS transistors Q41 and Q42 have same size to the PMOS transistor Q1 and Q2 of the drive current output circuit Dr1 respectively. The PMOS transistors Q51 and Q52 are the same size to the PMOS transistor Q1 and Q2 of the drive current output circuit Dr1 respectively.

Figure 5:
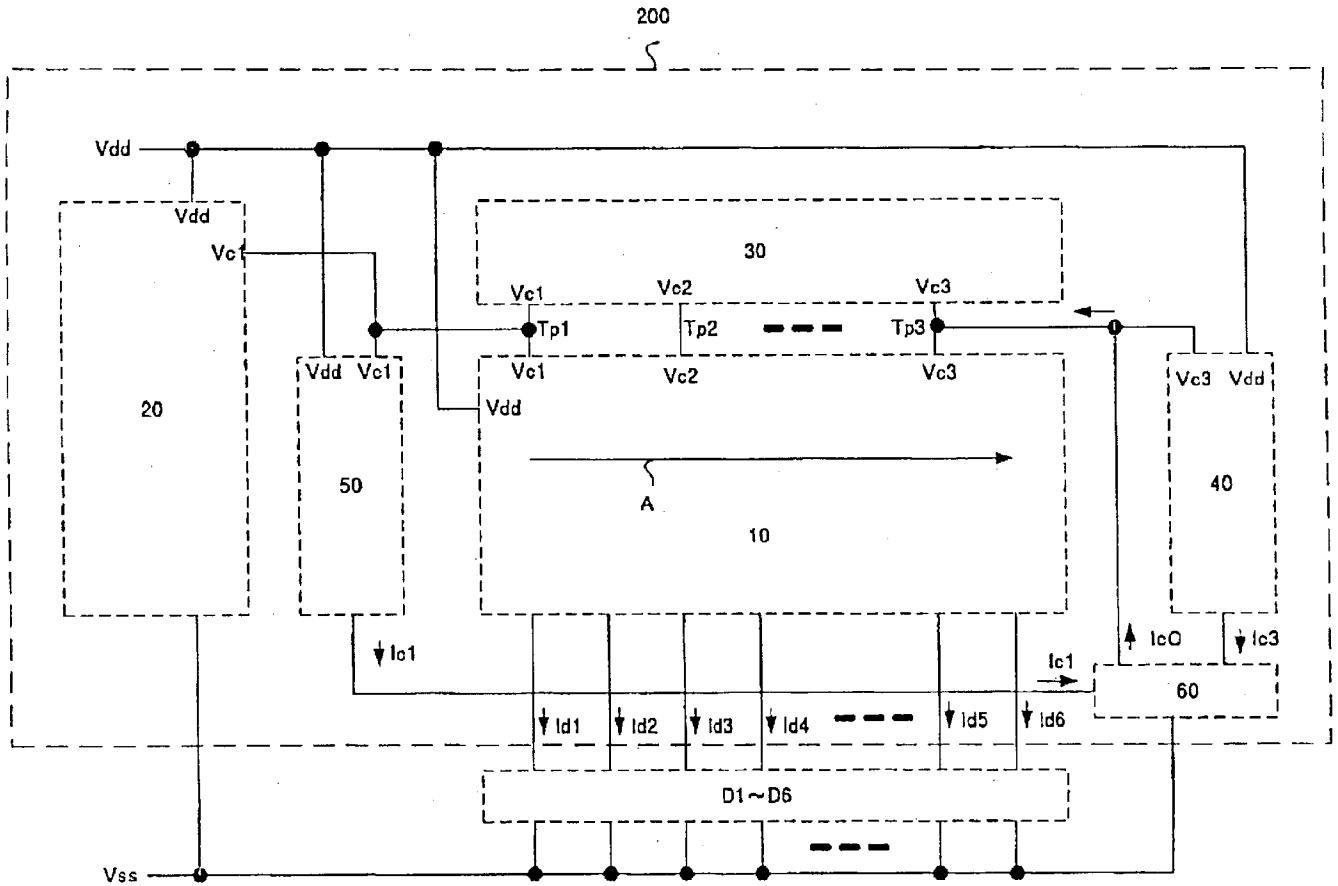
FIG. 5 is a layout diagram of the control circuit on a semiconductor substrate according to the first embodiment of the present invention.

FIG. 5 shows a layout diagram of the EL devices, the driver circuit unit and the control voltage generating circuit on the semiconductor substrate in the first embodiment of the present invention.

The drive current output circuits Dr1 through Dr6 are located in series and along the direction A in the driver circuit unit 10.

The first current output circuit 50 is located between the control voltage generating circuit 20 and the driver circuit unit 10 on the semiconductor substrate. That is, the first current output circuit 50 is located adjacent to the drive current output circuit Dr1 that is located nearest to the control voltage generating circuit 20.

The second current output circuit 40 is located far from the control voltage generating circuit 20. That is, the second current output circuit 40 is located adjacent to the drive current output circuit Dr6 that is farthest from the control voltage generating circuit 20.

The voltage divider 30 is located substantially in parallel to the driver circuit unit 10, so as to be located between the first current output circuit 50 and the second current output circuit 40.

The compensation voltage generating circuit 60 is located at a predetermined area of the semiconductor substrate. Since the compensation voltage generating circuit 60 outputs the compensation voltage Vcn to the output terminal Tp3 of the voltage divider 30, it is desirable that the compensation voltage generating circuit 60 is located near to the second current output circuit 40.

Since the first current output circuit 50 is located near to the drive current output circuit Dr1, characteristics of the transistors Q51 and Q52 in the first output circuit 50 are approximately equal to a characteristic or the transistors Q1 and Q2 of the drive current output circuit Dr1. As a result, the current Id1 that flows through the drive current output circuit Dr1 and the current Ic1 that flows through the first current output circuit 50 have an approximately same current value. Since the second current output circuit 40 is located near to the drive current output circuit Dr6, characteristics of the transistors Q41 and Q42 in the second current output circuit 40 are equal to a characteristic of the transistors Q11 and Q12 in the drive current output circuit Dr6. As a result, the current Id6 that flows through the driver current output circuit Dr6 and the current Ic3 that flows through the second current output circuit 40 have a substantially same value. Since a ground potential Vss is applied to the gates of the PMOS transistors Q$^{4}$2 and Q52, the transistors Q42 and the Q52 have always on state.

In the fabricated device, the characteristic of the transistors in the drive current output circuits and the first and second current output circuits are variously. Since the first current output circuit 50 is located near to the drive current output circuit Dr1, the reference current Ic1 and the drive current Id1 are approximately equal. Also, since the second current output circuit 40 is located near to the drive current output circuit Dr6, the reference current Ic2 and the drive current Id6 are approximately equal.

The operational amplifier OP61 generates the compensation voltage Vcn that is based on a difference between the voltage Vh1 and the voltage Vh3, and outputs the compensation voltage Vcn to the output terminal Tp3. The voltage Vh1 is supplied to the resistor R62 and the voltage Vh3 is supplied to the resistor R61. In order to apply the compensation voltage Vcn to the output terminal Tp3, the control voltage Vc3 becomes a voltage that Vc1+(R31+R32+ . . . +R33)*Ic0. As a result, the reference current Ic1 and the reference current Ic3 become equal. That is, the difference between the each of the drive current Id1 through Id6 outputted from the drive current output circuit Dr1 through Dr6 can be reduced.

Figure 6:
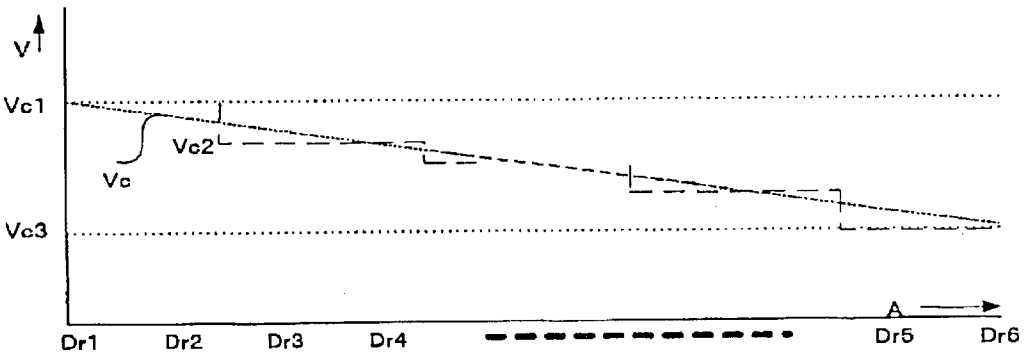
FIG. 6(*a*) is a diagram showing a voltage supplied to the drive current output circuit of the first embodiment of the present invention.
Figure 6:
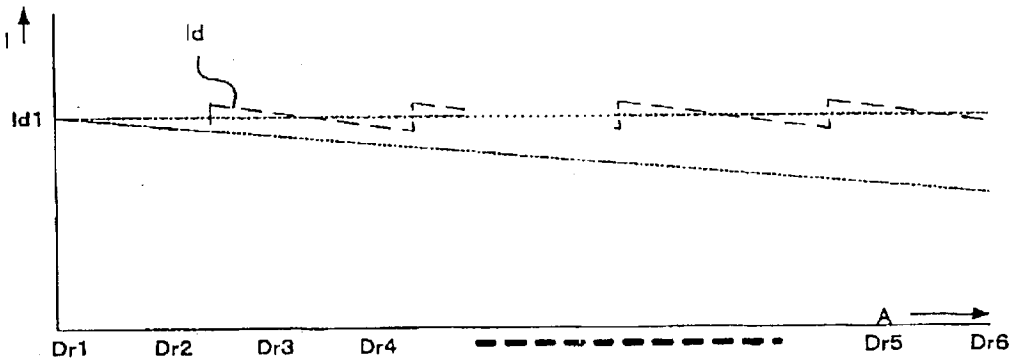

FIG. 6(*a*) shows the control voltages Vc1 through Vc3 in the output current of the drive current output circuit Dr1 through Dr6. FIG. 6(*b*) shows the drive current Id1 through Id6 in the drive current output circuit Dr1 through Dr6.

The control voltage Vc1 supplied to the drive current output circuit group 11 is higher than the control voltage Vc2 supplied to the drive current output circuit group 12. The drive current output circuit group 11 that includes the drive current output circuits Dr1 and Dr2 is located nearest to the control voltage generating circuit 20. The drive current output circuit group 12 that includes the drive current output circuits Dr3 and Dr4 is located next to the drive current output circuit group 11. The control voltage Vc3 supplied to the drive current output circuit group 13 is lowest in the control voltages Vc1, Vc2 and Vc3. The drive current output circuit group 13 is located farthest from the control voltage generating circuit 20.

In order to the operational amplifier OP61 is a transconductor amplifier, the operational amplifier OP61 outputs a current based on a difference of the input voltages.

Figure 7:
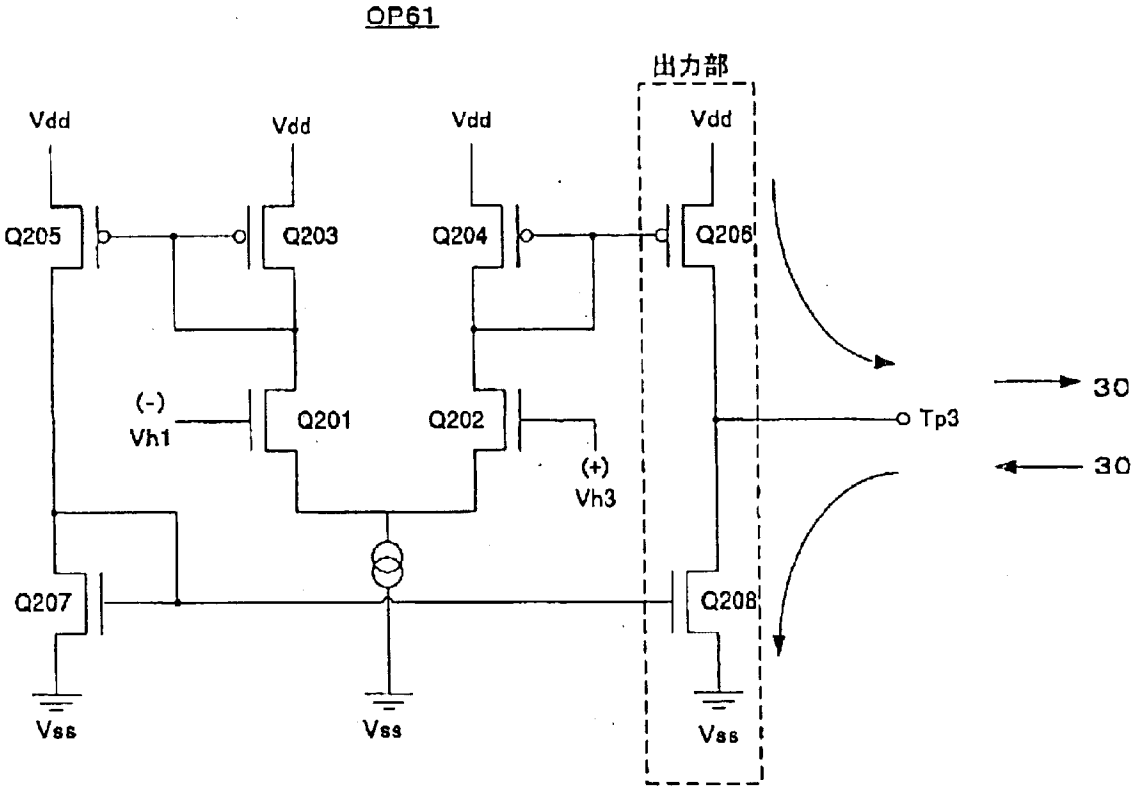
FIG. 7 is a circuit diagram of an operational amplifier in the control circuit.

FIG. 7 shows the diagram of the operational amplifier structured by the transconductor amplifier.

The operational amplifier OP61 includes PMOS transistors Q203, Q204, Q205 and Q206 and NMOS transistors Q201, Q202, Q207 and Q208. The PMOS transistor Q205 has a source connected to the power supply voltage Vss, a gate and a source. The PMOS transistor has a source connected to the power supply voltage Vdd, a gate connected to the gate of the PMOS transistor Q205 and a drain connected to the gate of the PMOS transistor Q203. The PMOS transistor Q204 has a source connected to the power supply voltage Vdd, a gate and a source connected to the gate of the PMOS transistor Q204. The PMOS transistor Q206 has a source connected to the power supply voltage, a gate connected to the gate of the PMOS transistor 204 and a drain connected to the output terminal Tp3. The NMOS transistor Q207 has a source connected to the ground potential Vss, a gate and a drain connected to the drain of the NMOS transistor Q205 and the gate of the gate of the NMOS transistor Q207. The NMOS transistor Q208 has a source connected to the ground potential Vss, a gate connected to the gate of the NMOS transistor Q207 and a drain connected to the output terminal Tp3. The NMOS transistor Q201 has a source connected to the Vss via a current source, a gate supplied to the input voltage Vh1 and a drain connected to the drain of the PMOS transistor Q203. The NMOS transistor Q202 has a source connected to the Vss via the current source, a gate supplied to the input voltage Vh3 and a drain connected to the drain of the PMOS transistor Q204.

In order to apply the voltage Vh1 to the NMOS transistor Q201, a current flows through the PMOS transistor Q203. The PMOS transistor Q203, the PMOS transistor Q205 and the NMOS transistor Q207 flow, through a same current each other. Then, a current that has a same value of the current flows through the NMOS transistor Q207 flows through the NMOS transistor Q208. Also, in order to apply the voltage Vh3 to the NMOS transistor Q202, the PMOS transistor Q204, the PMOS transistor Q206 and the NMOS transistor Q208 flow a same value of current. Therefore the current flows through the NMOS transistor Q208 is defined by the voltage Vhl, and the current flows through the PMOS transistor Q206 is defined by the voltage Vh3.

When the current Ic1 and the current Ic3 are equal, the output current that is outputted from the compensation voltage generating circuit 60 to the voltage divider 30 and the output current that is outputted from the voltage divider 30 to the compensation voltage generating circuit 60 are zero. When the current Ic3 is smaller than the current Ic1, the current flows from the voltage divider 30 to the compensation voltage generating circuit 60. That is, the output current flows from the voltage divider 30 to the ground potential Vss. When the current Ic3 is larger than the Ic1, the current flows from the compensation voltage generating circuit 60 to the voltage divider 30. That is, the output current flows from the power supply voltage Vdd to the voltage divider 30.

When the current Ic3 is smaller than the current Ic1, the current Ic0 that flows from the voltage divider 30 to the ground potential Vss via the compensation voltage generating circuit 60. As a result, the control voltage Vc1 that is applied on the output terminal Tp1 is largest in the control voltage Vc1, Vc2 and Vc3. The control voltage Vc3 that is applied on the output terminal Tp3 is smallest in the control voltage Vc1, Vc2 and Vc3.

In this embodiment, the current Id1 outputted from the drive current output circuit Dr1 that is located nearest to the control voltage generating circuit 20 and the current Id6 outputted from the drive current output circuit Dr6 that is located farthest from the control voltage generating circuit 20 are detected. The first current output circuit 50 outputs the reference current Ic1 that is the same value as the drive current Id1. The second current output circuit 40 output the reference current Ic3 that is the same value as the drive current Id6. Then, the current Ic0 compensates the difference between the current Ic1 and the current Ic3. Therefore, since the difference between the voltage Vc1 and the voltage Vc3 can be reduced, the difference between the output currents Id1 through Id6 for the EL devices D1 through D6 can be reduced.

Second Preferred Embodiment

Figure 8:
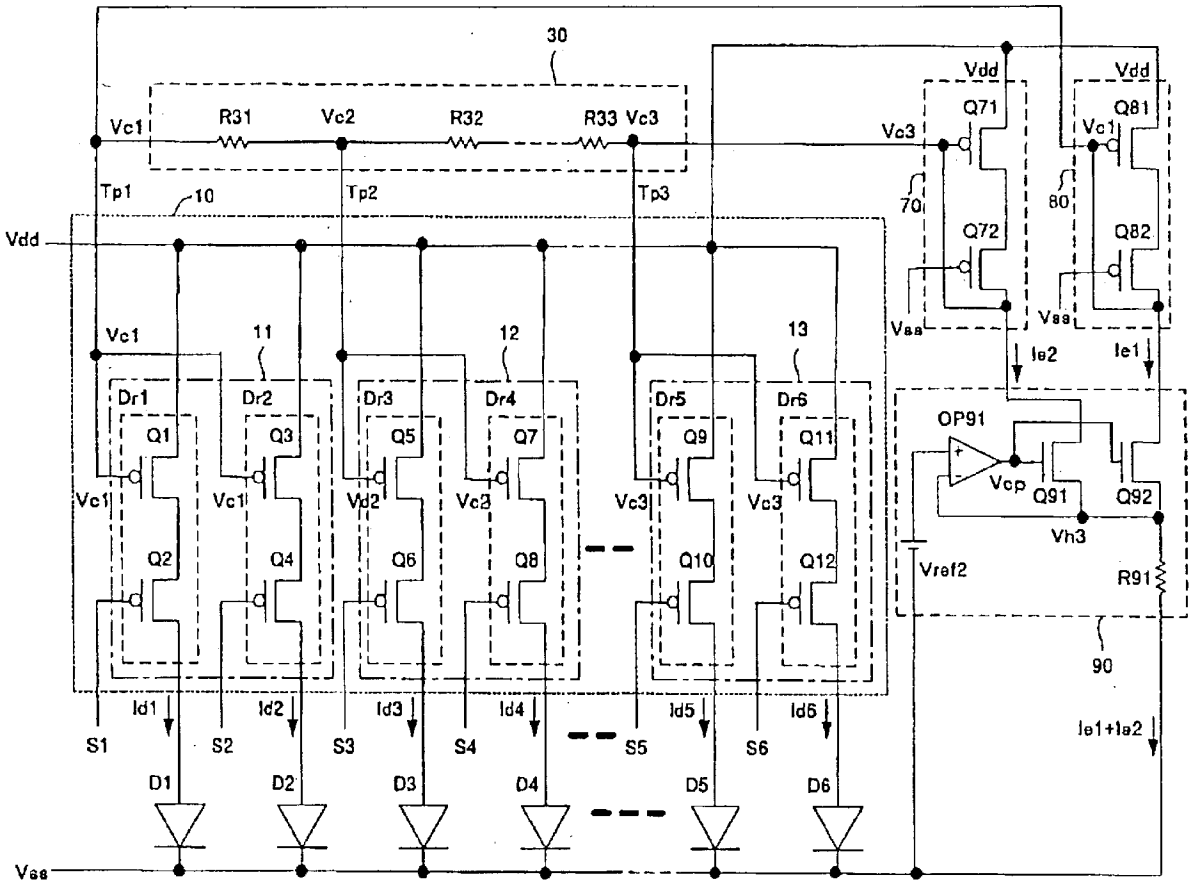
FIG. 8 is a circuit diagram of a control circuit according to a second embodiment of the present invention.

FIG. 8 is a detailed circuit diagram showing a control circuit according to a second embodiment of the present invention.

Differences between the control circuit according to the second embodiment and the control circuit according to the first embodiment are described as follows.

(8) A first converter 80 is added. The first converter 80 outputs the control voltage Vc1 to one end of the voltage divider 30 in response to a first reference current Ie1.

(9) A second converter 70 is added. The second converter 70 outputs the control voltage Vc3 to the other end of the voltage divider 30 in response to a second reference current Ie2.

(10) A reference current generator 90 is added. The reference current generator 90 generates the first reference current Ie1 and the second reference current Ie2.

(11) The reference current generator 90 includes a resistor R91, a first transistor Q92 and a second transistor Q91. The resistor R91 connected between the first and second converters and the ground node Vss. The first transistor Q92 is connected between the resistor R91 and the first converter 80. The second transistor Q91 is connected between the resistor R91 and the second converter 70.

(12) The reference current generator 90 includes an operational amplifier 91. The operational amplifier OP91 has an inversion terminal to which the voltage Vh3 is applied, a non-inversion terminal to which the predetermined reference voltage Vref2 is applied and an output terminal connected to a gate of the first transistor Q92 and a gate of the second transistor Q91. The non-inversion terminal is further connected to drains of the transistor Q91 and the transistor Q92.

(13) The first converter 80 is located adjacent to the drive current output circuit Dr1 on a semiconductor substrate 200. The second converter 70 is located adjacent to the drive current output circuit Dr6 on the semiconductor substrate 200.

In order to locate the first converter 80 adjacent to the drive current output circuit Dr1, the current-voltage characteristic of the current Id1 that flows through the drive current output circuit Dr1 and the control voltage Vc1 is substantially equal to the current-voltage characteristic at the first converter 80. In order to located the second converter 70 adjacent to the drive current output circuit Dr6, the current-voltage characteristic of the current Id6 that flows through the drive current output circuit Dr6 and the control voltage Vc3 is substantially equal to the current-voltage characteristic at the second converter 70. The PMOS transistor Q82 of the first converter 80 and the PMOS transistor Q72 of the second converter 70 are connected to the ground potential Vss.

Since the first converter is located adjacent to the drive current output circuit Dr1, the current Id1 that flows through the drive current output circuit Dr1 is in proportion to the first reference current Ie1. Since the second converter is located adjacent to the drive current output circuit Dr6, the current Id6 that flows through the drive current output circuit Dr6 is in proportion to the second reference current Ie2.

The PMOS transistor Q81 of the first converter 80 and the PMOS transistor Q71 of the second converter 70 have a substantially same characteristic to the each of the PMOS transistors Q1, Q3, Q5, Q7, Q9 and Q11. The PMOS transistor Q82 of the first converter 80 and the PMOS transistor Q72 of the second converter 70 have a substantially same characteristic to the each of the PMOS transistors Q2, Q4, Q6, Q8, Q10 and Q12. The PMOS transistor Q91 and Q92 has a substantially same characteristic each other.

A total current of the first reference current Ie2 and the second reference current Ie1 flow to the ground potential Vss via the resistor Q91.

The operational amplifier OP91 outputs an output voltage, so as to equalize the voltage applied to the inversion terminal and the voltage applied to non-inversion terminal. In order to the PMOS transistors Q91 and Q92 have a same characteristic and are located near each other, the second reference current Ie2 that flows through the transistor Q91 and the first reference current Ie1 that flows through the transistor Q92 become equal.

In order to control the current that flows through the transistor Q71 to the reference current Ie2, the gate voltage Vc3 of the transistor Q71 is defined. In order to control the current that flows through the transistor Q81 to the reference current Ie1, the gate voltage Vc1 of the transistor Q81 is defined.

Since the transistors Q 91 and the Q92 have a same characteristic, each of the reference current Ie2 and the reference current Ie1 are substantially equal and flows a half of the reference current that flows through the resistor R91.

In order to set the reference current Ie1 and reference current Ie2 are substantially same value, the drain current of the transistor Q71 and the drain current of the transistor Q81 are substantially equal. The voltage supplied to the transistor Q71 controls the reference current Ie2 and the transistor Q71 is controlled by the reference current Ie2. The voltage supplied to the transistor Q81 controls the reference current Ie1 and the transistor Q81 is controlled by the reference current Ie1.

When the drive current Id6 that flows through the transistor Q11 is smaller than the drive current Id1 that flows through the transistor Q1, the reference current Ie2 that flows through the transistor Q71 is smaller than the reference current Ie1 that flows through the transistor Q81. For equalizing the reference current Ie1 and the reference current Ie2, the current that flows through the transistor Q71 and the current flows through the transistor Q81 may be equaled. For equalizing the current flows through the transistor Q71 to the current flows through the transistor Q81, the voltage between the source and the drain of the transistor Q71 may be increased. That is, the voltage Vc3 is reduced. As a result, the output current Id6 flows through the drive current output circuit Dr6 is increased.

In order to use the voltage divider 30, the drive current output circuits Dr2 through Dr5 that is located between the drive current output circuits Dr1 and Dr6 can be received an appropriate control voltage from the respective nodes of the voltage divider 30.

According to the second embodiment, the control voltage Vc1 and the control voltage Vc3 are generated individually based on the respective drive currents Id1 through Id6. As a result, the drive currents Id1 through Id6 can be equalized each other.

Further, since the control circuit of the second embodiment does not have a feedback loop, the control circuit does not occur an oscillation.

Third Preferred Embodiment

Figure 9:
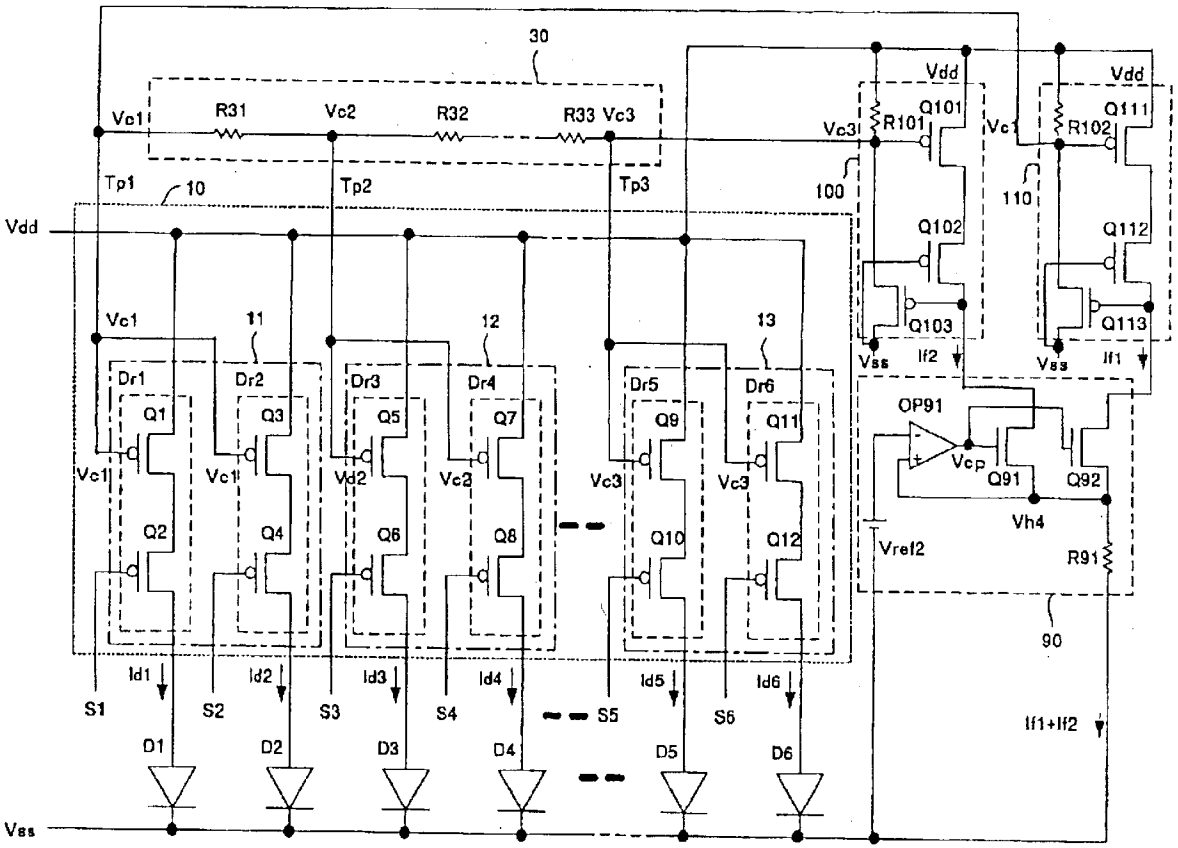
FIG. 9 is a circuit diagram of a control circuit according to a third embodiment of the present invention.

FIG. 9 is a detailed circuit diagram showing a control circuit according to a third embodiment of the present invention.

The difference between the control circuit according to the third embodiment and the control circuit according to the second embodiment described as follows.

A first converter 110 and a second converter 100 are used. The first converter 110 has a PMOS transistor Q111, a PMOS transistor Q112, a PMOS transistor Q113 and a resistor R102. The PMOS transistor Q111 has a source which is applied a power supply voltage Vdd, a gate connected to a first node which is applied a control voltage Vc1 and a drain. The PMOS transistor Q112 has a source connected to the drain of the PMOS transistor Q111, a gate connected to the ground potential Vss and a drain for outputting a first reference current If1. The resistor R102 connected between the power supply voltage Vdd and the first node. The PMOS transistor Q113 connected between the first node and the ground potential Vss, and the gate of the PMOS transistor Q113 is connected to the drain of the PMOS transistor Q112.

The second converter 100 has a PMOS transistor Q101, a PMOS transistor Q102, a PMOS transistor Q103 and a resistor R101. The PMOS transistor Q101 has a source which is applied a power supply voltage Vdd, a gate connected to a second node which is applied a control voltage Vc3 and a drain. The PMOS transistor Q102 has a source connected to the drain of the PMOS transistor Q101, a gate connected to the ground potential Vss and a drain for outputting a second reference current If2. The resistor R101 connected between the power supply voltage Vdd and the second node. The PMOS transistor Q103 connected between the second node and the ground potential Vss, and the gate of the PMOS transistor Q103 is connected to the drain of the PMOS transistor Q102.

The resistor R102 and the PMOS transistor Q113 constitutes a first impedance converter with a source follower circuit. An output impedance z0 of the source follower circuit in the first converter 110 is a 1/gm ("gm" is a transconductance of the transistor Q113). According to set a characteristic of the transistor Q113 appropriately, the output impedance z0 can be set to low value. Also, in the second converter 100, the output impedance sets to low value.

According to the third embodiment, the impedance in the first converter 110 and the second converter 100 are low. Therefore, the resistance values of the resistor R31 through R33 in the voltage divider 30 are reduced. As a result, a cross talk noise occurred on the control voltage Vc1 through Vc3 can be reduced.

Further, there is no route of the current that flows through the voltage divider 30 to the reference current If1 or the reference current If2. As a result, the difference between the drive currents Id1 through Id6 is reduced.

While the impedance converter according to the third embodiment is constituted from the source follower circuit using the PMOS transistor, the impedance circuit does not limited to the circuit. For example, an emitter follower circuit using a PNP type bipolar transistor or a voltage follower circuit using an operational amplifier can be used.

While each of the drive current output circuit groups 11 through 13 according to the respective embodiments includes a two drive current output circuits, each group can includes any number of the drive current output circuits. Each group can include one drive current output circuit or can include three drive current output circuits and more.

While the preferred form of the present invention has been described, it is to be understood that modifications will be apparent to those skilled in the art without departing from the spirit of the invention. The scope of the invention is to be determined solely by the following claims.

What is claimed is:

1. A control circuit comprising:

a plurality of drive current output circuit groups, each of which includes at least one drive current output circuit;

a control voltage generating circuit which has an output node;

a voltage divider which has a plurality of control voltage outputting nodes and a plurality of resistance elements, wherein each of said resistance elements is connected between the respective control voltage outputting nodes, wherein the plurality of control voltage outputting nodes including a first end node which is located at one end of the voltage divider and a second end node which is located at the other end of the voltage divider, wherein the first end node is connected to the output node of the control voltage generating circuit, and wherein each of the control voltage outputting nodes supplies a control voltage to the respective drive current output circuit groups;

a first current output circuit which outputs a first current based on the voltage of the first end node;

a second current output circuit which outputs a second current based on the voltage of the second end node; and a compensation voltage generating circuit which outputs a compensation voltage to the second end of the voltage divider, wherein the compensation voltage compensates a difference between the first current and the second current.

2. The control circuit according to claim 1, wherein the drive current output circuit groups are located in series of the drive current output circuit groups, wherein the first current output circuit is located one end of the series and the second current output circuit is located the other end of the series of the drive current output circuit groups.

3. The control circuit according to claim 1, wherein each of the drive current output circuit groups includes a first transistor having a first terminal which is supplied a first power supply voltage, a second terminal and a gate terminal which is connected to the control voltage outputting node, and a second transistor having a first terminal which is connected to the second terminal of the first transistor, a second terminal which is supplied a second power supply voltage and a gate terminal which is supplied a switching signal.

4. The control circuit according to claim 1, wherein the drive current output circuit groups are located in series, wherein the control voltage generating circuit is located near the one end of the drive current output circuit groups.

5. The control circuit according to claim 1, wherein each of the drive current output circuit groups includes a plurality of the drive current output circuits.

6. A control circuit comprising:

a first drive current output circuit which has a first, a second and a third nodes, wherein the first power supply voltage is supplied from the first node and a first drive current is outputted from the third node;

a second drive current output circuit which has a first, a second and a third nodes, wherein the first power supply voltage is supplied from the first node and a second drive current is outputted from the third node;

a control voltage generating circuit which is located near the first current output circuit, the control voltage generating circuit has an output node which outputs a first control voltage to the second node of the first drive current output circuit and a second control voltage to the second node of the second drive current output circuit via a resistor element;

a first current output circuit which outputs a first detected current based on the first control voltage;

a second current output circuit which outputs a second detected current based on the second control voltage; and a compensation voltage generating circuit which outputs a compensation voltage to the second current output circuit, so as to equalize the first detected current and the second detected current.

7. A control circuit comprising:

a plurality of drive current output circuit groups each of which includes at least one drive current output circuit;

a voltage divider which has a plurality of control voltage outputting nodes each of which is divided by a resistance element each other, wherein the plurality of control voltage outputting nodes including a first end node which is located at one end of the voltage divider and a second end node which is located at the other end of the voltage divider, wherein each of the control voltage outputting node supplies a control voltage to the respective drive current output circuit group;

a first converter which outputs a control voltage of the first end node based on a first reference current;

a second converter which outputs a control voltage of the second end node based on a second reference current; and a reference current generator which controls the first current and the second current to be approximately equal.

8. The control circuit according to claim 7, wherein the drive current output circuit groups are located in series, wherein the first converter is located one end of the series of the drive current output circuit groups and the second converter is located the other end of the series of the drive current output circuit groups.

9. The control circuit comprising according to claim 7, wherein the first converter includes a first transistor has a source connected to a power supply voltage, a gate connected to the first end node and a drain, and a second transistor has a source connected to the drain of the first transistor, a gate connected to the ground potential and a drain outputting the first current, and wherein the second converter includes a third transistor has a source connected to the power supply voltage, a gate connected to the second end node and a drain, and a fourth transistor has a source connected to the drain of the third transistor, a gate connected to the ground potential and a drain outputs the second current.

10. The control circuit according to claim 7, wherein the first converter includes a first transistor, a second transistor a third transistor and a first resistor, wherein the first transistor has a source connected to a power supply voltage, a gate connected to the first end node and a drain, wherein the second transistor has a source connected to the drain of the first transistor, a gate connected to a ground potential and a drain outputs the first current, wherein the first resistor has a first end connected to the power supply voltage and second end connected to the gate of the first transistor, wherein the third transistor has a first terminal connected to the second end of the first resistor, a second terminal connected to the ground potential and a gate connected to the drain of the second transistor; and wherein the second converter includes a fourth transistor, a fifth transistor, a sixth transistor and a second resistor, wherein the fourth transistor has a source connected to a power supply voltage, a gate connected to the second end node and a drain, wherein the fifth transistor has a source connected to the drain of the fourth transistor, a gate connected to a ground potential and a drain outputs the second current, wherein the second resistor has a first end connected to the power supply voltage and second end connected to the gate of the fourth transistor, wherein the sixth transistor has a first terminal connected to the second end of the second resistor, a second terminal connected to the ground potential and a gate connected to the drain of the fifth transistor.

* * * * *